US009776851B2

(12) United States Patent
Chen

(10) Patent No.: US 9,776,851 B2
(45) Date of Patent: Oct. 3, 2017

(54) HORSE BUCKLE

(71) Applicant: Tom-Jeff Manufacturers, Inc., Taoyuan County (TW)

(72) Inventor: Jien-Liang Chen, Taoyuan County (TW)

(73) Assignee: TOM-JEFF MANUFACTURERS, INC., Taoyuan County (TW)

( * ) Notice: Subject to any disclaimer, the term of this patent is extended or adjusted under 35 U.S.C. 154(b) by 295 days.

(21) Appl. No.: 14/594,172

(22) Filed: Jan. 12, 2015

(65) Prior Publication Data

US 2016/0200563 A1 Jul. 14, 2016

(51) Int. Cl.
*A44B 11/24* (2006.01)
*B68C 1/14* (2006.01)

(52) U.S. Cl.
CPC ..... *B68C 1/14* (2013.01); *A44B 11/24* (2013.01)

(58) Field of Classification Search
CPC A44B 11/24; B68C 1/14; B68C 1/145; B68C 1/142; B68C 2001/145; B68C 2001/142
USPC ..... 24/68 E, 380, 314, 317, 308, 307
See application file for complete search history.

(56) References Cited

U.S. PATENT DOCUMENTS 368,274 A * 8/1887 Boyd ..... A44B 11/24 24/178

* cited by examiner

*Primary Examiner* — Jack W Lavinder
(74) *Attorney, Agent, or Firm* — Leong C. Lei

(57) ABSTRACT

A horse buckle includes a buckle ring seat; a prong movably coupled to the buckle ring seat; an elastic unit arranged between the buckle ring seat and the prong and including an elastic element having two end respectively fixed to the buckle ring seat and the prong, a barrel fit outside the elastic element, and a pin mounted to one side of the buckle ring seat and movably coupled to the prong; and a support unit movably mounted to an end the buckle ring seat. As such, the buckle ring seat is coupled to a girth for use and receives a fastening strap to extend through the buckle ring seat and a restoration spring force of an elastic element makes a prong quickly seated in a positioning hole of the fastening strap.

4 Claims, 4 Drawing Sheets

HORSE BUCKLE

TECHNICAL FIELD OF THE INVENTION

The present invention generally relates to a design of a buckle for horses, and more particularly to a buckle for jointing a horse girth and fastening strap.

DESCRIPTION OF THE PRIOR ART

A conventional horse girth buckle (as shown in FIG. 4) generally comprises a body 7 in the form of an elongate ring. The body 7 comprises, on opposite sides thereof, side bars 71 between which a movable pin 72 is arranged. An elastic element 73 is coupled between an end of the pin 72 and the body 7 with two ends of the elastic element 73 respectively connected to the pin 72 and the body 7, whereby the pin 72 can be moved by applying a force thereto in order to receive a fastening strap to extend into the body 7. Afterwards, the pin 72 is released and the spring force of the elastic element 73 completes the buckling operation.

However, in such a conventional horse girth buckle, the elastic element 73 is exposed between the pin 72 and the body 7. Besides being bad looking and deteriorating quality, the exposure of the elastic element 73 makes it easy to entangle with external objects, leading to unexpected detachment. Further, the exposure of the elastic element 73 may also cause potential risks of hurting tackle operators, riders, and even horses, making the operation safety of riding questionable.

SUMMARY OF THE INVENTION

The primary object of the present invention is to allow a buckle ring seat to couple to a girth for use and, with a fastening strap being set through the buckle ring seat, to make use of a restoration spring force of an elastic element included in an elastic unit to have a prong quickly seated in a positioning hole of the fastening strap, whereby besides an effect of being easy to operate, the internally arranged elastic element causes no harm to the tackle operator, the rider, and the horse so as to enhance the operation security of horse riding and improve the feeling of fashion and quality.

To achieve the above object, the present invention provides a horse buckle, which comprises a buckle ring seat; a prong, which is movably coupled to the buckle ring seat; an elastic unit, which is arranged between the buckle ring seat and the prong and comprises an elastic element having two ends respectively fixed to the buckle ring seat and the prong, a barrel fit outside the elastic element, and a pin, which is mounted to one side of the buckle ring seat and movably coupled to the prong; and a support unit, which is movably mounted to an end of the buckle ring seat.

In an embodiment of the present invention, the buckle ring seat comprises two opposite side bars, a cross bar mounted to an end of the two side bars, two positioning sections respectively formed on the side bars at the opposite end thereof and movably coupled to the support unit, through holes respectively formed in the positioning sections, a reinforcing bar mounted between the two side bars, an axle mounted to one of the side bars and rotatably coupled to the prong, and a retention hole formed in the other one of the side bars for receiving and fixing one end of the elastic element.

In an embodiment of the present invention, the prong has an end to which a sleeve is mounted. The sleeve has two ends in which a first axle hole and a second axle hole are respectively formed for coupling to the axle and the pin and a constraint hole formed at a location adjacent to the second axle hole for receiving and fixing another end of the elastic element.

In an embodiment of the present invention, the elastic element comprises a torsion spring.

In an embodiment of the present invention, the support unit comprises a rotary shaft, a circumferential groove formed in a middle of the rotary shaft, corresponding holes respectively formed in two ends of the rotary shaft to correspond to the through holes formed in the positioning sections, and coupling pins respectively received and retained in the through holes and partly and movably received in the corresponding holes.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
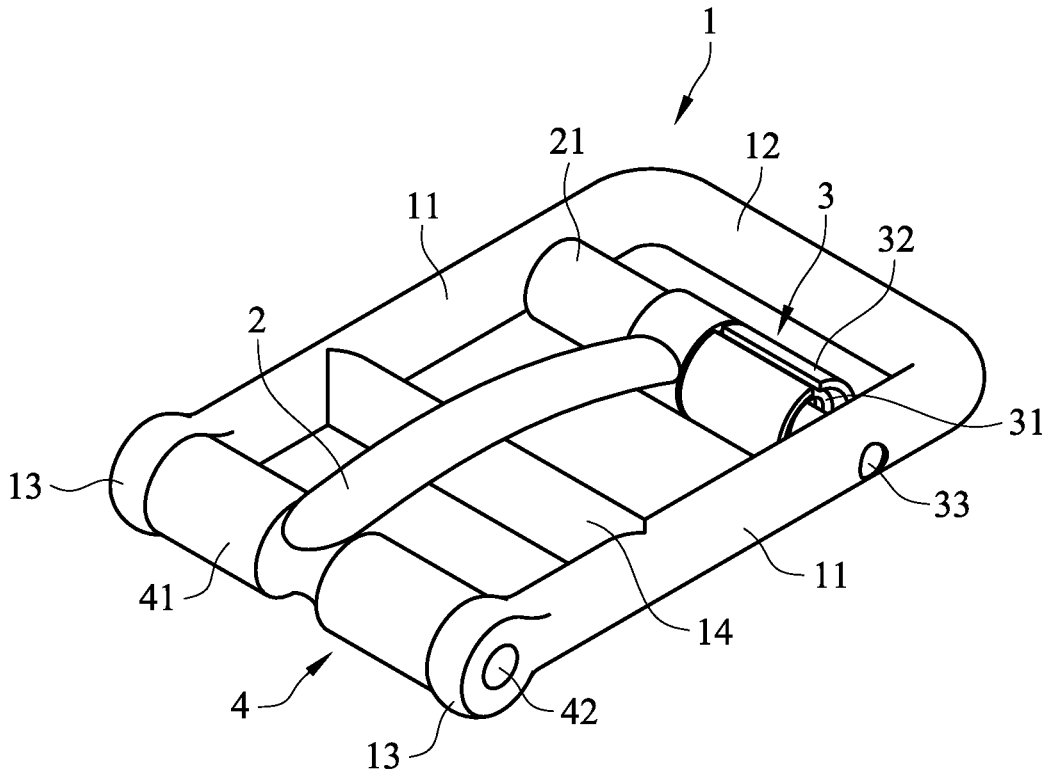
FIG. 1 is a perspective view of the present invention.
Figure 2:
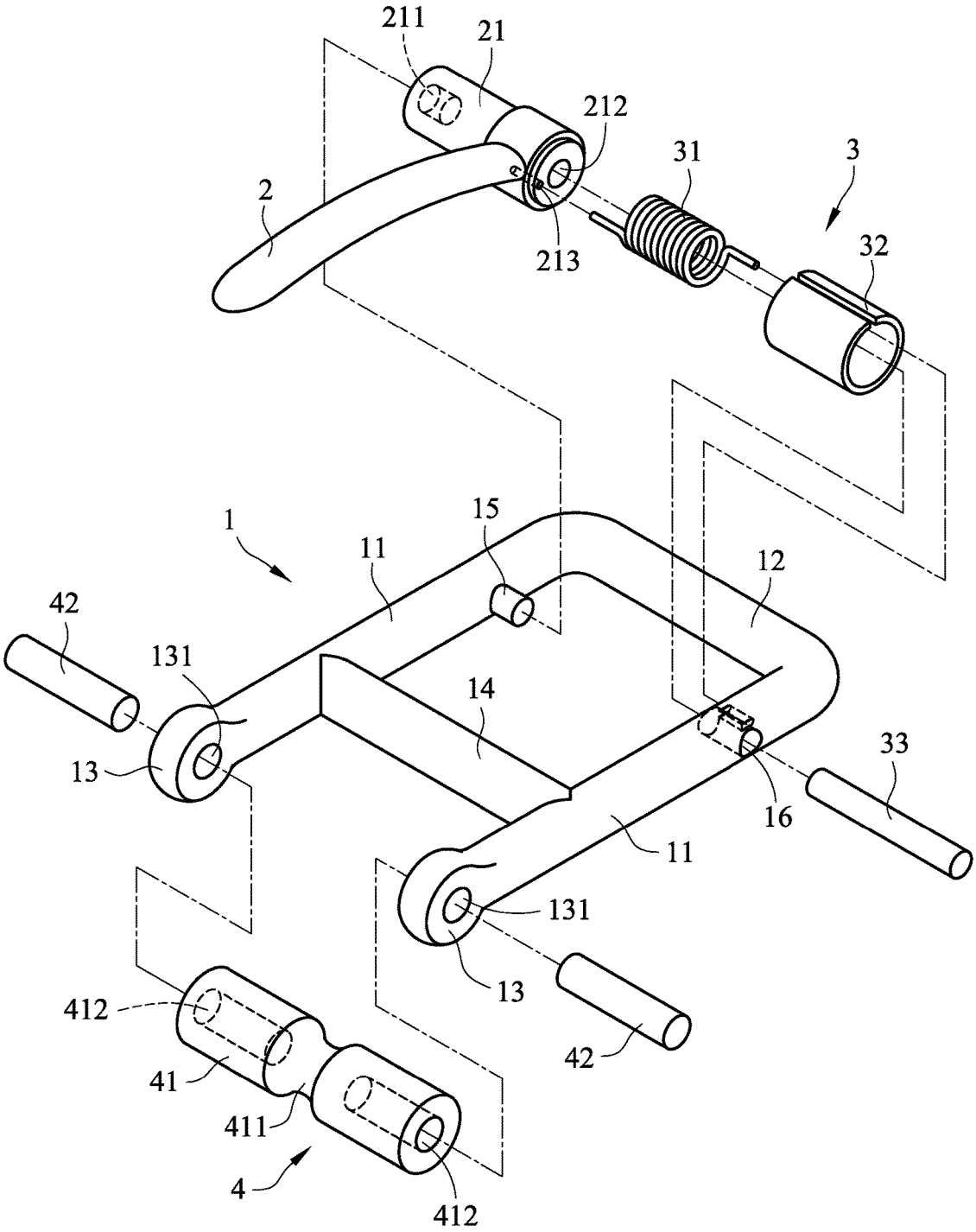
FIG. 2 is an exploded view of the present invention.
Figure 3:
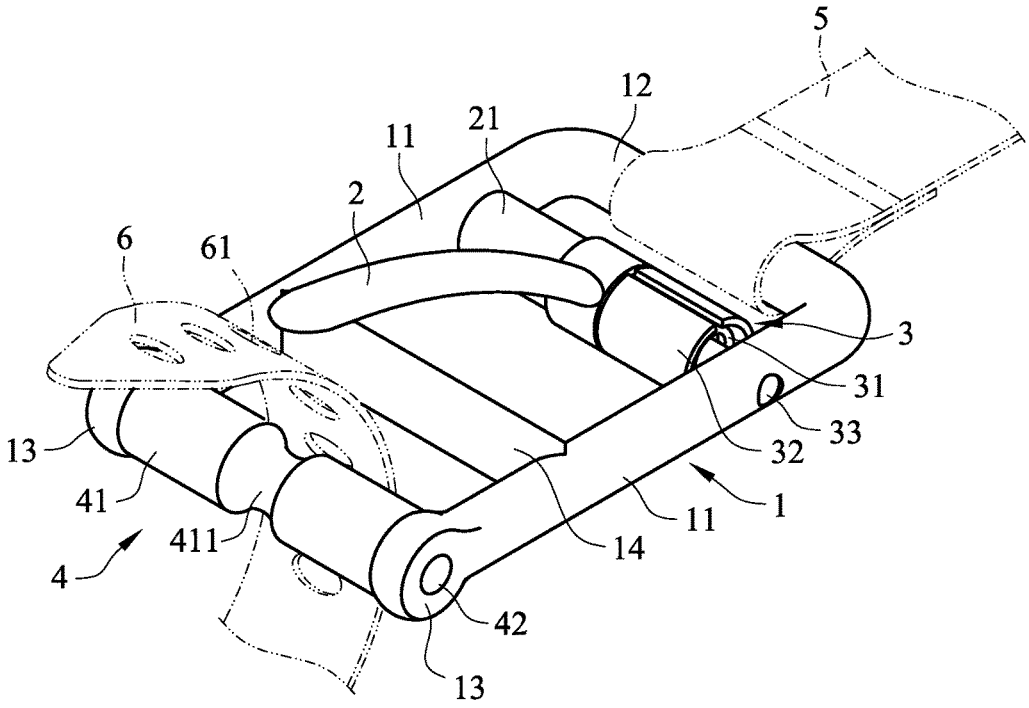
FIG. 3 is a schematic view illustrating a use of the present invention.
Figure 4:
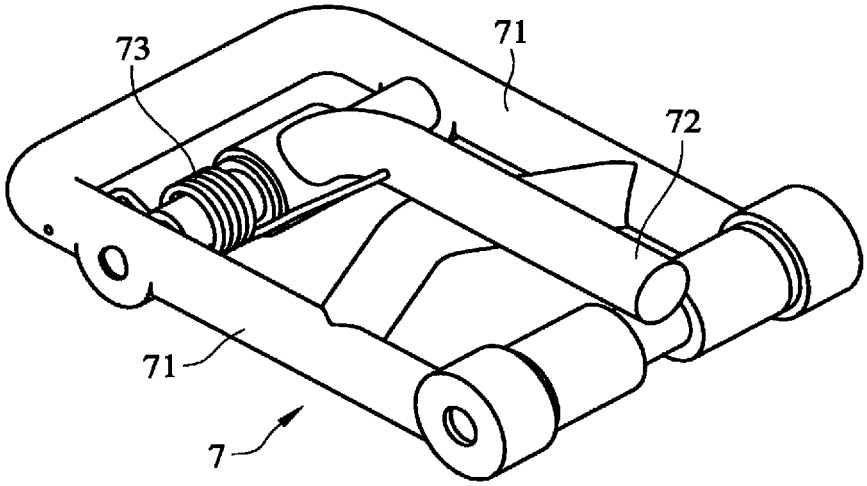
PRIOR ART FIG. 4
FIG. 4 is a perspective view of the prior art.

Referring to FIGS. 1, 2, and 3, which are respectively a perspective view, an exploded view, a schematic view illustrating a use of the present invention, as shown in the drawings, the present invention provides a horse buckle, which comprises, at least, a buckle ring seat 1, a prong 2, an elastic unit 3, and a support unit 4.

The buckle ring seat 1 comprises two opposite side bars 11, a cross bar 12 mounted to an end of the two side bars 11, two positioning sections 13 respectively formed on the side bars 11 at the opposite end thereof, through holes 131 respectively formed in the positioning sections 13, a reinforcing bar 14 mounted between the two side bars 11, an axle 15 mounted to one of the side bars 11, and a retention hole 16 formed in the other one of the side bars 11.

The prong 2 is movably coupled to the buckle ring seat 1. The prong 2 has an end to which a sleeve 21 is mounted. The sleeve 21 has two opposite ends in which a first axle hole 211 and a second axle hole 212 are respectively formed. The first axle hole 211 rotatably receives the axle 15 therein to be coupled thereto. A constraint hole 213 is formed at a location adjacent to the second axle hole 212.

The elastic unit 3 is arranged between the buckle ring seat 1 and the prong 2. The elastic unit 3 comprises an elastic element 31 having two ends respectively fixed in the retention hole 16 of the buckle ring seat 1 and the constraint hole 213 of the prong 2, a barrel 32 fit outside the elastic element 31, and a pin 33 extending through the retention hole 16 and movably coupled to the second axle hole 212. The elastic element 31 comprises a torsion spring.

The support unit 4 is movably mounted to one end of the buckle ring seat 1. The support unit 4 comprises a rotary shaft 41 mounted between the two positioning sections 13, a circumferential groove 411 formed in a middle of the rotary shaft 41, corresponding holes 412 respectively formed in two ends of the rotary shaft 41 to correspond to the through holes 131 formed in the positioning sections 13, and coupling pins 42 respectively received and retained in the through holes 131 and partly and movably received in the corresponding holes 412 so that the rotary shaft 41 forms a gap with respect to each of the positioning sections 13 to allow the rotary shaft 41 to rotate. As such, the combination of the above components constitutes a brand new horse buckle.

To use the present invention, a girth 5 is coupled to the cross bar 12 of the buckle ring seat 1. A tackle operator or a rider in an attempt to use the present invention may extend a fastening strap 6 through the space between the reinforcing bar 14 of the buckle ring seat 1 and the rotary shaft 41 of the support unit 4 (the fastening strap 6 can be forcibly inserted through or can be put therethrough by first moving away the prong 2), with the prong 2 being pulled and lifted and the elastic element 31 compressed, so that when the fastening strap 6 is further pulled and moved, the rotary shaft 41 is caused to rotate in compliance with the movement to allow the fastening strap 6 to be moved and adjusted readily. Once the fastening strap 6 has been pulled and moved to a desired location for adjustment, the prong 2 is acted upon by the restoration spring force of the elastic element 31 of the elastic unit 3 to have the prong 2 quickly set into one of the positioning holes 61 of the fastening strap 6 and positioned on and received in the circumferential groove 411 formed in the middle of the rotary shaft 41. On the other hand, to release the fastening strap 6, the fastening strap 6 is pulled to cause the prong 2 to separate from the positioning hole 61 of the fastening strap 6 and also compress the elastic element 31. As such, the fastening strap 6 can be withdrawn from the space between the reinforcing bar 14 of the buckle ring seat 1 and the rotary shaft 41 of the support unit 4 to complete the operation of release. For the operations of use and release as described above, the tackle operator or the rider can use only one hand to easily carry out the operations. The elastic element 31 that is received in the barrel 32 in a concealed form does not cause any potential risk of hurting the tackle operator, the rider, and the horse and does not detach due to being entangled and pulled by an external force thereby ensuring sufficient operation security for horse preparing and riding.

Further, to manufacture of the present invention, the pin 33 and the coupling pins 42 are respectively fit through the retention hole 16 and the through holes 131 first and then outside portions of the retention hole 16 and the through hole 131 are subjected to welding and grinding for smoothening. Such a manufacturing process prevents the pin 33 and the coupling pins 42 from detachment and, in addition to operation security, provides a feeling of quality.

In summary, the present invention provides a horse buckle that can effectively overcome the shortcomings of the prior art and allows for use by having the buckle ring seat coupled to a girth and with a fastening strap being set through the buckle ring seat, makes use of the restoration spring force of the elastic element include in the elastic unit to have the prong quickly seated in the positioning hole of the fastening strap, whereby besides an effect of being easy to operate, the internally arranged elastic element causes no harm to tackle operators, riders, and horses so as to enhance the operation security of horse riding and improve the feeling of fashion and quality.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A horse buckle, comprising:

a buckle ring seat;

a prong, which is movably coupled to the buckle ring seat;

an elastic unit, which is arranged between the buckle ring seat and the prong and comprises an elastic element having two ends respectively fixed to the buckle ring seat and the prong, a barrel fit outside the elastic element, and a pin, which is mounted to one side of the buckle ring seat and movably coupled to the prong; and a support unit, which is movably mounted to an end of the buckle ring seat;

wherein the buckle ring seat comprises two opposite side bars, a cross bar mounted to an end of the two side bars, two positioning sections respectively formed on the side bars at the opposite end thereof and movably coupled to the support unit, through holes respectively formed in the positioning sections, a reinforcing bar mounted between the two side bars, an axle mounted to one of the side bars and rotatably coupled to the prong, and a retention hole formed in the other one of the side bars for receiving and fixing one end of the elastic element.

2. The horse buckle according to claim 1, wherein the prong has an end to which a sleeve is mounted, the sleeve having two ends in which a first axle hole and a second axle hole are respectively formed for coupling to the axle and the pin and a constraint hole formed at a location adjacent to the second axle hole for receiving and fixing another end of the elastic element.

3. The horse buckle according to claim 2, wherein the elastic element comprises a torsion spring.

4. The horse buckle according to claim 1, wherein the support unit comprises a rotary shaft, a circumferential groove formed in a middle of the rotary shaft, corresponding holes respectively formed in two ends of the rotary shaft to correspond to the through holes formed in the positioning sections, and coupling pins respectively received and retained in the through holes and partly and movably received in the corresponding holes.

* * * * *